US010269377B2

(12) United States Patent
VanBlon et al.

(10) Patent No.: US 10,269,377 B2
(45) **Date of Patent: *Apr. 23, 2019**

(54) DETECTING PAUSE IN AUDIBLE INPUT TO DEVICE

(71) Applicant: Lenovo (Singapore) Pte. Ltd., Singapore (SG)

(72) Inventors: Russell Speight VanBlon, Raleigh, NC (US); Suzanne Marion Beaumont, Wake Forest, NC (US); Rod David Waltermann, Rougemont, NC (US)

(73) Assignee: LENOVO (SINGAPORE) PTE. LTD., Singapore (SG)

( * ) Notice: Subject to any disclaimer, the term of this patent is extended or adjusted under 35 U.S.C. 154(b) by 0 days.

This patent is subject to a terminal disclaimer.

(21) Appl. No.: 16/118,919

(22) Filed: Aug. 31, 2018

(65) Prior Publication Data

US 2018/0374501 A1 Dec. 27, 2018

Related U.S. Application Data

(63) Continuation of application No. 14/095,369, filed on Dec. 3, 2013.

(51) Int. Cl.
*G10L 25/48* (2013.01)
*G10L 25/87* (2013.01)

(52) U.S. Cl.
CPC ..... *G10L 25/87* (2013.01); *G10L 25/48* (2013.01)

(58) Field of Classification Search
None
See application file for complete search history.

(56) References Cited

U.S. PATENT DOCUMENTS 2,510,344 A 6/1950 Law
2,567,654 A 9/1951 Jan
(Continued)

FOREIGN PATENT DOCUMENTS

CN 101132839 B 9/2011
CN 103914131 A 7/2014
(Continued)

OTHER PUBLICATIONS

"Relationship Between Inches, Picas, Points, Pitch, and Twips", Article ID: 76388; http;//support2.microsoft.com/KB/76388, printed Oct. 10, 2014.

(Continued)

*Primary Examiner* — Thuykhanh Le
(74) *Attorney, Agent, or Firm* — John L. Rogitz; John M. Rogitz

(57) ABSTRACT

A device includes a processor and a memory accessible to the processor and bearing instructions executable by the processor to process an audible input sequence provided by a user of the device, determine that a pause in providing the audible input sequence has occurred at least partially based on a first signal from at least one camera communicating with the device, cease to process the audible input sequence responsive to a determination that the pause has occurred, determine that providing the audible input sequence has resumed based at least partially based on a second signal from the camera, and resume processing of the audible input sequence responsive to a determination that providing the audible input sequence has resumed.

20 Claims, 4 Drawing Sheets

(56) References Cited

U.S. PATENT DOCUMENTS 3,418,426 A 12/1968 Herbert et al.
3,628,854 A 12/1971 Jampolsky
4,082,433 A 4/1978 Appeldorn et al.
4,190,330 A 2/1980 Berreman
4,577,928 A 3/1986 Brown
5,579,037 A 11/1996 Tahara et al.
5,583,702 A 12/1996 Cintra
6,046,847 A 4/2000 Takahashi
6,243,683 B1 6/2001 Peters
6,839,670 B1 * 1/2005 Stammler ..... G10L 15/063 704/251
7,133,535 B2 * 11/2006 Huang ..... G06K 9/00335 382/100
7,231,351 B1 * 6/2007 Griggs ..... G10L 15/26 704/243
7,890,327 B2 * 2/2011 Dorai ..... H04N 5/783 704/245
8,655,320 B2 * 2/2014 Stakutis ..... H04M 1/72547 455/412.1
9,106,789 B1 * 8/2015 Shipman, Jr. ..... H04N 7/147
2003/0018475 A1 * 1/2003 Basu ..... G06K 9/00228 704/270
2003/0093280 A1 * 5/2003 Oudeyer ..... G10L 13/033 704/266
2003/0171932 A1 9/2003 Juang et al.
2004/0048636 A1 * 3/2004 Doble ..... H04M 1/274566 455/563
2004/0160419 A1 8/2004 Padgitt
2006/0028556 A1 * 2/2006 Bunn ..... G10L 15/25 348/211.99
2006/0206724 A1 * 9/2006 Schaufele ..... G06F 21/32 713/186
2007/0124507 A1 * 5/2007 Gurram ..... G06F 3/0481 710/1
2008/0091636 A1 4/2008 Ferlitsch
2008/0180218 A1 * 7/2008 Flax ..... G06F 19/322 340/10.1
2008/0184284 A1 * 7/2008 O'Hern ..... H04H 60/48 725/28
2009/0065578 A1 3/2009 Peterson et al.
2009/0138507 A1 * 5/2009 Burckart ..... G11B 27/105
2009/0204410 A1 8/2009 Mozer et al.
2009/0259349 A1 10/2009 Golenski
2009/0315740 A1 12/2009 Hildreth et al.
2010/0079508 A1 4/2010 Hodge et al.
2010/0171720 A1 7/2010 Craig et al.
2010/0211918 A1 8/2010 Liang et al.
2010/0280828 A1 * 11/2010 Fein ..... G10L 15/1822 704/246
2011/0039237 A1 * 2/2011 Skare ..... G05B 23/0267 434/118
2011/0065451 A1 3/2011 Danado et al.
2011/0071830 A1 * 3/2011 Kim ..... G01C 21/3602 704/246
2011/0112836 A1 * 5/2011 Kurki-Suonio ..... G10L 15/30 704/235
2012/0149309 A1 6/2012 Hubner et al.
2012/0220311 A1 8/2012 Rodriguez et al.
2012/0268268 A1 10/2012 Bargero
2012/0271636 A1 * 10/2012 Fujisawa ..... G10L 15/22 704/270
2012/0304067 A1 * 11/2012 Han ..... G06F 3/167 715/728
2013/0021459 A1 * 1/2013 Vasilieff ..... G10L 25/78 348/77
2013/0044042 A1 2/2013 Olsson et al.
2013/0085757 A1 * 4/2013 Nakamura ..... G10L 15/22 704/254
2013/0170755 A1 7/2013 Dalton et al.
2013/0246663 A1 9/2013 Raveendran et al.
2013/0271557 A1 * 10/2013 Kato ..... H04N 7/15 348/14.07
2013/0290986 A1 * 10/2013 Kobayashi ..... G06F 3/01 719/318
2013/0307771 A1 11/2013 Parker et al.
2014/0071163 A1 * 3/2014 Kinnebrew ..... G03H 1/2249 345/633
2014/0081630 A1 * 3/2014 Jung ..... G10L 21/0316 704/225
2014/0081634 A1 * 3/2014 Forutanpour ..... G06F 17/289 704/235
2014/0176767 A1 6/2014 Hamel et al.
2014/0214404 A1 * 7/2014 Kalia ..... G06F 17/28 704/9
2014/0229168 A1 * 8/2014 Pandya ..... G10L 21/0264 704/219
2014/0278441 A1 * 9/2014 Ton ..... G10L 21/00 704/275
2014/0317524 A1 10/2014 VanBlon et al.
2015/0080048 A1 * 3/2015 Fang ..... H04M 1/72519 455/550.1
2015/0100157 A1 * 4/2015 Houssin ..... G10L 15/1815 700/246
2015/0110287 A1 * 4/2015 Holdren ..... B60R 11/0247 381/86
2015/0161992 A1 * 6/2015 Jung ..... G10L 15/083 704/251
2015/0293905 A1 * 10/2015 Wang ..... G06F 17/2785 704/9

FOREIGN PATENT DOCUMENTS

CN 102023703 B 3/2015
DE 69937592 10/2008
DE 10310794 10/2012
EP 0880090 A2 11/1998
WO 2004051392 A2 6/2004
WO 2014133714 A1 9/2014

OTHER PUBLICATIONS

"Understanding & Using Directional Microphones", SOS, Sep. 2000, http;//www.soundonsound.com/sos/sep00/articles/direction.htm.
Arthur Davis, Frank Kuhnlenz, "Optical Design Using Fresnel Lenses, Basic Principles and Some Practical Examples", Optik & Photonik, Dec. 2007.
Darren Quick, "PixelOptics to Launch world's first electronic focusing eyewear", Jan. 12, 2011, http;//www.gizmag.com/pixeloptics-empower-electronic-focusing-glasses/17569/.
Extron, "Digital Connection, Understanding EDID—Extending Display Identification Data", Fall 2009, www.extron.com.
Insight News, "Electronic-lens company PixelOptics is bankrupt", http;//www.insightnews.com.au/_blog/NEWS-NOW!/post/lens/electronic-lens-sompany-pixeloptics-is-bankrupt/ Dec. 12, 2013.
Isource: "Raise to Speak Makes Siri Wonderfully Useful (Once You Know How to Use It)", http://isource.com/10/01/raise-to-speak-makes-siri-wonderfully-useful-once-you-know-how-to-use-it./ Web printout retrieved Nov. 15, 2013.
Superfocus, "See the World in Superfocus Revolutionary Eyeglasses Give You the Power to Focus Your Entire View at Any Distance", http;//superfocus.com/eye-care-practitioners, printed from website Jun. 24, 2014.
Tactus Technology, "Taking Touch Screen Interfaces Into a New Dimension", 2012 (13 pages).
Thalmiclabs, "Myo Gesture Control Armband", http://www.thalmic.com/en/myo, printed from website Jan. 27, 2015.
Thalmiclabs, "Myo-Tech Specs", http;//www.thalmic.com/en/myo/techspecs, printed from website Jan. 27, 2015.
Wikipedia, "Beamforming", definition; http://en.wikipedia.org/wiki/Beamforming, printed from website Jan. 22, 2015.
Wikipedia, "Electromyography", definition; http;//en.wikipedia.org/wiki/Electromyography, printed from website Jan. 27, 2015.
Wikipedia, "Extended Display Identification Data", Definition; http;//en.wikipedia.org/wiki/Extended_display_identification_data, printed from website Oct. 10, 2014.

(56) References Cited

OTHER PUBLICATIONS

Wikipedia, "Microphone Array", definition, http;//en.wikipedia.org/wiki/Microphone_array, printed from website Jan. 22, 2015.
Wikipedia, "Microphone", definition; http://en.wikipedia.org/wiki/microphone, printed from website Jan. 22, 2015.
Wikipedia, "Polarizer", definition; http;//en.wikipedia.org/wiki/Polarizer, printed from website Jan. 14, 2015.
Wikipedia, "Smart Glass", definition, http;//en.wikipedia.org/wiki/Smart_glass, printed from website Jan. 14, 2015.

* cited by examiner

DETECTING PAUSE IN AUDIBLE INPUT TO DEVICE

FIELD

The present application relates generally to detecting a pause in audible input to a device.

BACKGROUND

When inputting an audible input sequence such as a command to a device such as a computer, a pause in the audible input sequence can cause the computer to stop "listening" for the audible input sequence in that e.g. the device stops processing the sequence and/or times out, and hence does not fully process the command.

Also in some instances, what the device may determine to be a pause in the audible input sequence may actually be silence after the user has finished providing the audible input sequence and waits for the device to process the audible input sequence. In such an instance, this may cause the device to process audio not intended to be input to the device and can even e.g. unnecessarily drain the device's battery.

SUMMARY

Accordingly, in a first aspect a device includes a processor and a memory accessible to the processor and bearing instructions executable by the processor to process an audible input sequence provided by a user of the device, determine that a pause in providing the audible input sequence has occurred at least partially based on a first signal from at least one camera communicating with the device, cease to process the audible input sequence responsive to a determination that the pause has occurred, determine that providing the audible input sequence has resumed based at least partially based on a second signal from the camera, and resume processing of the audible input sequence responsive to a determination that providing the audible input sequence has resumed.

In some embodiments, the pause may include an audible sequence separator that is unintelligible to the device. Furthermore, the audible sequence separator may be determined to be unintelligible at least in part based on execution of lip reading software on at least the first signal, where the first signal may be generated by the camera responsive to the camera gathering at least one image of at least a portion of the user's face.

Furthermore, in some embodiments the instructions may be further executable by the processor to determine to cease to process the audible input sequence responsive to processing a signal from an accelerometer on the device except when also at least substantially concurrently therewith receiving the audible sequence separator. Additionally, if desired the first and second signals may be respectively generated by the camera responsive to the camera gathering at least one image of at least a portion of the user's face.

What's more, if desired the pause may include a pause in the user providing audible input to the device. Thus, the determination that the pause has occurred at least partially based on the first signal may include a determination that the user's current facial expression is indicative of not being about to provide audible input. In some embodiments, the determination that the user's current facial expression is indicative of not being about to provide audible input may include a determination that the user's mouth is at least mostly closed or completely closed.

Also if desired, the determination that providing the audible input sequence has resumed at least partially based on the second signal may include a determination that the user's mouth is open. The determination that the pause has occurred at least partially based on the first signal may include a determination that the user's mouth is open and at least substantially still, and/or may include a determination that the user's eyes are not looking at the device or toward the device.

In another aspect, a method includes receiving an audible input sequence at a device that is provided by a user of the device, determining that the user has stopped providing the audible input sequence responsive to receiving a first signal from at least one camera in communication with the device and responsive to receiving input from a touch-enabled display at least in communication with the device, and then determining that the user has resumed providing the audible input sequence.

In still another aspect, an apparatus includes a first processor, a network adapter, and storage bearing instructions for execution by a second processor for processing an audible input command provided by a user of a device associated with the second processor and executing the audible input command. The processing of the audible input command is responsive to determining based on at least one signal from at least one camera in communication with the second processor that the user's mouth is moving while looking in the direction of the device. Furthermore, the first processor transfers the instructions over the network via the network adapter to the device.

The details of present principles, both as to their structure and operation, can best be understood in reference to the accompanying drawings, in which like reference numerals refer to like parts, and in which:

DETAILED DESCRIPTION

Figure 1:
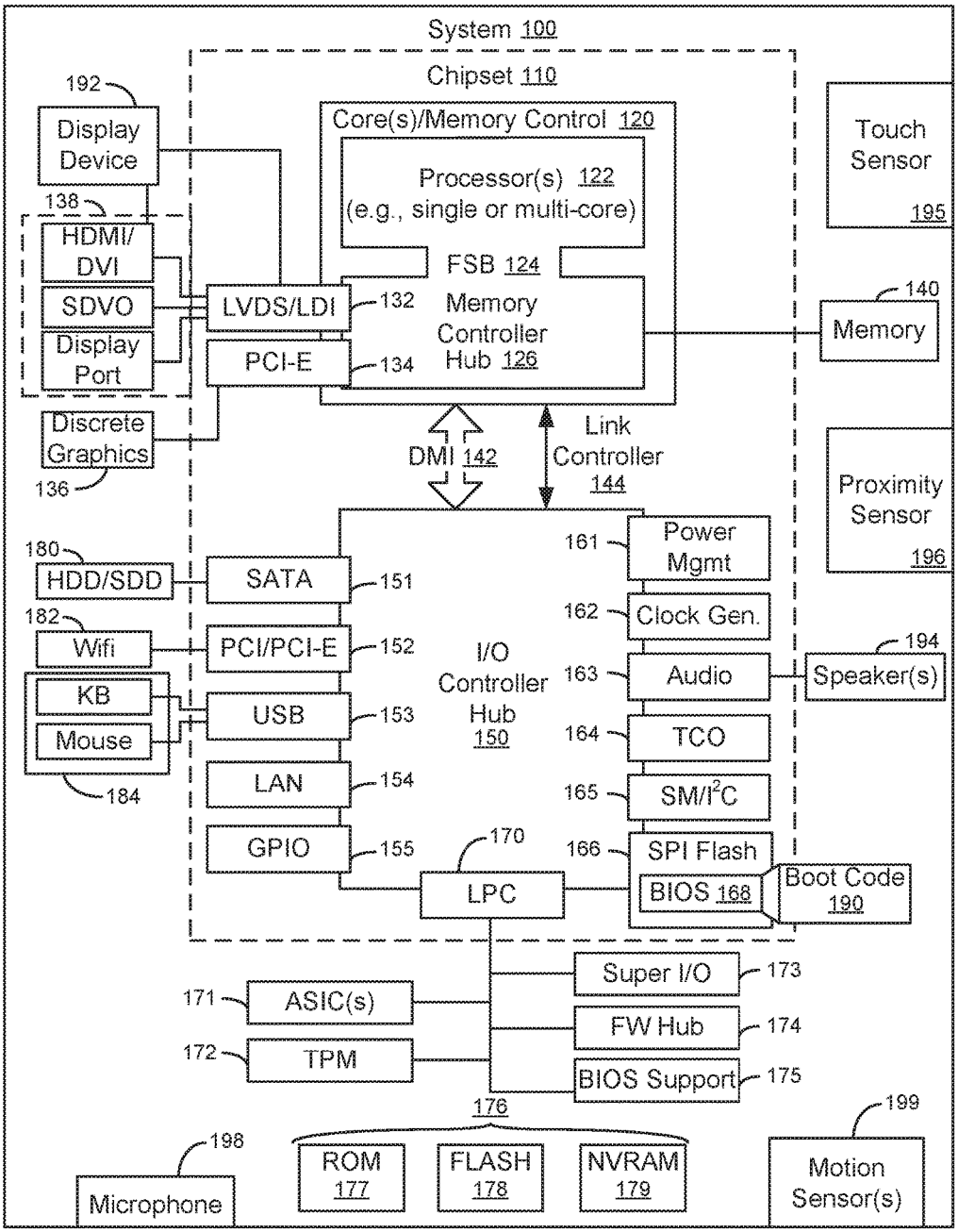
FIG. 1 is a block diagram of an exemplary device in accordance with present principles.

This disclosure relates generally to (e.g. consumer electronics (CE)) device based user information. With respect to any computer systems discussed herein, a system may include server and client components, connected over a network such that data may be exchanged between the client and server components. The client components may include one or more computing devices including televisions (e.g. smart TVs, Internet-enabled TVs), computers such as laptops and tablet computers, and other mobile devices including smart phones. These client devices may employ, as non-limiting examples, operating systems from Apple. Google, or Microsoft. A UNIX operating system may be used. These operating systems can execute one or more browsers such as a browser made by Microsoft or Google or Mozilla or other browser program that can access web applications hosted by the Internet servers over a network such as the Internet, a local intranet, or a virtual private network.

As used herein, instructions refer to computer-implemented steps for processing information in the system. Instructions can be implemented in software, firmware or hardware; hence, illustrative components, blocks, modules, circuits, and steps are set forth in terms of their functionality.

A processor may be any conventional general purpose single- or multi-chip processor that can execute logic by means of various lines such as address lines, data lines, and control lines and registers and shift registers. Moreover, any logical blocks, modules, and circuits described herein can be implemented or performed, in addition to a general purpose processor, in or by a digital signal processor (DSP), a field programmable gate array (FPGA) or other programmable logic device such as an application specific integrated circuit (ASIC), discrete gate or transistor logic, discrete hardware components, or any combination thereof designed to perform the functions described herein. A processor can be implemented by a controller or state machine or a combination of computing devices.

Any software and/or applications described by way of flow charts and/or user interfaces herein can include various sub-routines, procedures, etc. It is to be understood that logic divulged as being executed by e.g. a module can be redistributed to other software modules and/or combined together in a single module and/or made available in a shareable library.

Logic when implemented in software, can be written in an appropriate language such as but not limited to C# or C++, and can be stored on or transmitted through a computer-readable storage medium (e.g. that may not be a carrier wave) such as a random access memory (RAM), read-only memory (ROM), electrically erasable programmable read-only memory (EEPROM), compact disk read-only memory (CD-ROM) or other optical disk storage such as digital versatile disc (DVD), magnetic disk storage or other magnetic storage devices including removable thumb drives, etc. A connection may establish a computer-readable medium. Such connections can include, as examples, hard-wired cables including fiber optics and coaxial wires and twisted pair wires. Such connections may include wireless communication connections including infrared and radio.

In an example, a processor can access information over its input lines from data storage, such as the computer readable storage medium, and/or the processor can access information wirelessly from an Internet server by activating a wireless transceiver to send and receive data. Data typically is converted from analog signals to digital by circuitry between the antenna and the registers of the processor when being received and from digital to analog when being transmitted. The processor then processes the data through its shift registers to output calculated data on output lines, for presentation of the calculated data on the device.

Components included in one embodiment can be used in other embodiments in any appropriate combination. For example, any of the various components described herein and/or depicted in the Figures may be combined, interchanged or excluded from other embodiments.

"A system having at least one of A, B, and C" (likewise "a system having at least one of A, B, or C" and "a system having at least one of A, B, C") includes systems that have A alone, B alone, C alone, A and B together, A and C together, B and C together, and/or A, B, and C together, etc.

The term "circuit" or "circuitry" is used in the summary, description, and/or claims. As is well known in the art, the term "circuitry" includes all levels of available integration. e.g., from discrete logic circuits to the highest level of circuit integration such as VLSI, and includes programmable logic components programmed to perform the functions of an embodiment as well as general-purpose or special-purpose processors programmed with instructions to perform those functions.

Now specifically in reference to FIG. 1, it shows an exemplary block diagram of a computer system 100 such as e.g. an Internet enabled, computerized telephone (e.g. a smart phone), a tablet computer, a notebook or desktop computer, an Internet enabled computerized wearable device such as a smart watch, a computerized television (TV) such as a smart TV, etc. Thus, in some embodiments the system 100 may be a desktop computer system, such as one of the ThinkCentre® or ThinkPad® series of personal computers sold by Lenovo (US) Inc. of Morrisville, N.C., or a workstation computer, such as the ThinkStation®, which are sold by Lenovo (US) Inc. of Morrisville, N.C.; however, as apparent from the description herein, a client device, a server or other machine in accordance with present principles may include other features or only some of the features of the system 100.

As shown in FIG. 1, the system 100 includes a so-called chipset 110. A chipset refers to a group of integrated circuits, or chips, that are designed to work together. Chipsets are usually marketed as a single product (e.g., consider chipsets marketed under the brands INTEL®, AMD®, etc.).

In the example of FIG. 1, the chipset 110 has a particular architecture, which may vary to some extent depending on brand or manufacturer. The architecture of the chipset 110 includes a core and memory control group 120 and an I/O controller hub 150 that exchange information (e.g., data, signals, commands, etc.) via, for example, a direct management interface or direct media interface (DMI) 142 or a link controller 144. In the example of FIG. 1, the DMI 142 is a chip-to-chip interface (sometimes referred to as being a link between a "northbridge" and a "southbridge").

The core and memory control group 120 include one or more processors 122 (e.g., single core or multi-core, etc.) and a memory controller hub 126 that exchange information via a front side bus (FSB) 124. As described herein, various components of the core and memory control group 120 may be integrated onto a single processor die, for example, to make a chip that supplants the conventional "northbridge" style architecture.

The memory controller hub 126 interfaces with memory 140. For example, the memory controller hub 126 may provide support for DDR SDRAM memory (e.g., DDR, DDR2, DDR3, etc.). In general, the memory 140 is a type of random-access memory (RAM). It is often referred to as "system memory."

The memory controller hub 126 further includes a low-voltage differential signaling interface (LVDS) 132. The LVDS 132 may be a so-called LVDS Display Interface (LDI) for support of a display device 192 (e.g., a CRT, a flat panel, a projector, a touch-enabled display, etc.). A block 138 includes some examples of technologies that may be supported via the LVDS interface 132 (e.g., serial digital video, HDMI/DVI, display port). The memory controller hub 126 also includes one or more PCI-express interfaces (PCI-E) 134, for example, for support of discrete graphics 136. Discrete graphics using a PCI-E interface has become an alternative approach to an accelerated graphics port (AGP). For example, the memory controller hub 126 may include a 16-lane (×16) PCI-E port for an external PCI-E-based graphics card (including e.g. one of more GPUs). An exemplary system may include AGP or PCI-E for support of graphics.

The I/O hub controller 150 includes a variety of interfaces. The example of FIG. 1 includes a SATA interface 151, one or more PCI-E interfaces 152 (optionally one or more legacy PCI interfaces), one or more USB interfaces 153, a LAN interface 154 (more generally a network interface for communication over at least one network such as the Internet, a WAN, a LAN, etc. under direction of the processor(s) 122), a general purpose I/O interface (GPIO) 155, a low-pin count (LPC) interface 170, a power management interface 161, a clock generator interface 162, an audio interface 163 (e.g., for speakers 194 to output audio), a total cost of operation (TCO) interface 164, a system management bus interface (e.g., a multi-master serial computer bus interface) 165, and a serial peripheral flash memory/controller interface (SPI Flash) 166, which, in the example of FIG. 1, includes BIOS 168 and boot code 190. With respect to network connections, the I/O hub controller 150 may include integrated gigabit Ethernet controller lines multiplexed with a PCI-E interface port. Other network features may operate independent of a PCI-E interface.

The interfaces of the I/O hub controller 150 provide for communication with various devices, networks, etc. For example, the SATA interface 151 provides for reading, writing or reading and writing information on one or more drives 180 such as HDDs, SDDs or a combination thereof, but in any case the drives 180 are understood to be e.g. tangible computer readable storage mediums that may not be carrier waves. The I/O hub controller 150 may also include an advanced host controller interface (AHCI) to support one or more drives 180. The PCI-E interface 152 allows for wireless connections 182 to devices, networks, etc. The USB interface 153 provides for input devices 184 such as keyboards (KB), mice and various other devices (e.g., cameras, phones, storage, media players, etc.).

In the example of FIG. 1, the LPC interface 170 provides for use of one or more ASICs 171, a trusted platform module (TPM) 172, a super I/O 173, a firmware hub 174, BIOS support 175 as well as various types of memory 176 such as ROM 177, Flash 178, and non-volatile RAM (NVRAM) 179. With respect to the TPM 172, this module may be in the form of a chip that can be used to authenticate software and hardware devices. For example, a TPM may be capable of performing platform authentication and may be used to verify that a system seeking access is the expected system.

The system 100, upon power on, may be configured to execute boot code 190 for the BIOS 168, as stored within the SPI Flash 166, and thereafter processes data under the control of one or more operating systems and application software (e.g., stored in system memory 140). An operating system may be stored in any of a variety of locations and accessed, for example, according to instructions of the BIOS 168.

In addition to the foregoing, the system 100 also may include at least one touch sensor 195 providing input to the processor 122 and configured in accordance with present principles for sensing a user's touch when the user e.g. holds or touches the system 100. In some embodiments, such as e.g. the device 100 being a smart phone, the touch sensor 195 may be positioned on the system 100 along respective side walls defining planes orthogonal to e.g. a front surface of the display device 192. The system 100 may also include a proximity, infrared, sonar, and/or heat sensor 196 providing input to the processor 122 and configured in accordance with present principles for sensing e.g. body heat of a person and/or the proximity of at least a portion of the person (e.g. the person's cheek or face) to at least a portion of the system 100 such as the sensor 196 itself.

Further still, in some embodiments the system 100 may include one or more cameras 197 providing input to the processor 122. The camera 197 may be, e.g., a thermal imaging camera, a digital camera such as a webcam, and/or a camera integrated into the system 100 and controllable by the processor 122 to gather pictures/images and/or video in accordance with present principles (e.g. to gather one or more images of a user face, mouth, eyes, etc.). Moreover, the system 100 may include an audio receiver/microphone 198 for e.g. entering audible input such as an audible input sequence (e.g. an audible commands) to the system 100 to control the system 100. Additionally, the system 100 may include one or more motion sensors 199 (e.g., an accelerometer, gyroscope, cyclometer, magnetic sensor, infrared (IR) motion sensors such as passive IR sensors, an optical sensor, a speed and/or cadence sensor, a gesture sensor (e.g. for sensing gesture command), etc.) providing input to the processor 122 in accordance with present principles.

Figure 2:
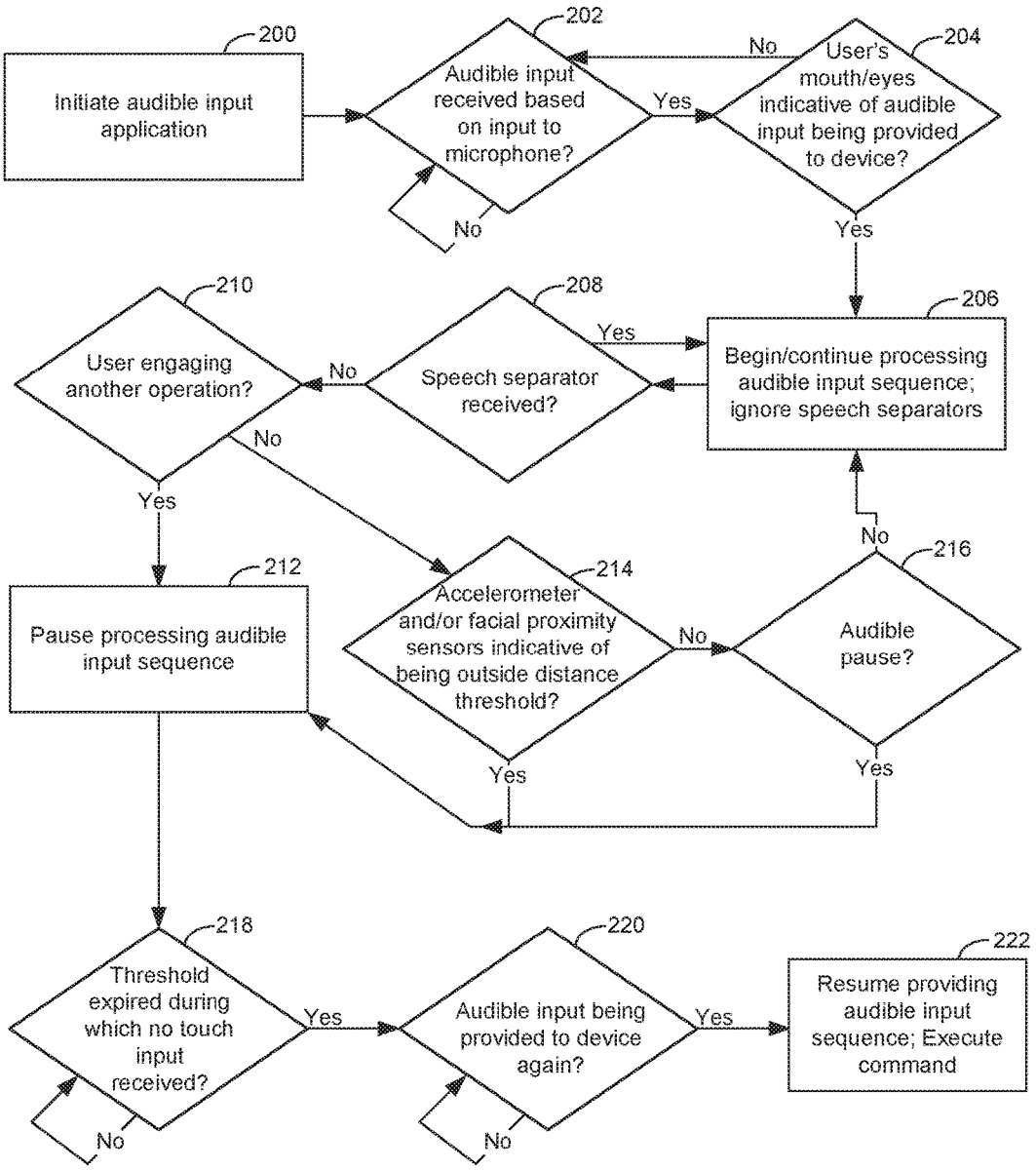
FIG. 2 is an example flowchart of logic to be executed by a device in accordance with present principles.

Before moving on to FIG. 2 and as described herein, it is to be understood that an exemplary client device or other machine/computer may include fewer or more features than shown on the system 100 of FIG. 1. In any case, it is to be understood at least based on the foregoing that the system 100 is configured to undertake present principles (e.g. receive audible input from a user, store and execute and/or undertake the logic described below, and/or perform any other functions and/or operations described herein).

Now in reference to FIG. 2, an example flowchart of logic to be executed by a device such as the system 100 described above in accordance with present principles is shown. Beginning at block 200, the logic initiates an audible input application (e.g. an electronic "personal assistant") for processing audible input and/or executing a function responsive thereto in accordance with present principles, such as e.g. an audibly provided command from a user. The audible input application may be initiated e.g. automatically responsive to user input selecting an icon associated with the audible input application and presented on a touch enabled display such as the display device 192 described above. In any case, the logic proceeds from block 200 to decision diamond 202 where the logic determines whether audible input is being received at the device and/or provided by the user to the device undertaking the logic of FIG. 2 (referred to in reference to the remaining description of FIG. 2 as "the device") based on e.g. audible input sensed by a microphone of the device and/or based on at least one image from a camera in communication with the device (e.g. used to determine that the user's lips are moving with the device within a threshold distance of the device and hence is providing audible input to the device). If the logic determines that no such audible input is being provided by the user and/or received by the device, the logic may continue making the determination of diamond 202 until an affirmative determination is made.

Once an affirmative determination is made at diamond 202, the logic proceeds to decision diamond 204 where the logic determines (e.g. based on signals from a camera in communication with the device) whether the user's mouth and/or eyes are indicative of the user providing audible input to the device (e.g. using lip reading software, eye tracking software, etc.). Thus, for instance, one or more signals from a camera gathering images of a user and providing them to a processor of the device may be analyzed, examined, etc. by the device for whether the user's mouth is open, which may be determined by the processor of the device (e.g. based on mouth tracking software, and/or based on correlating using a lookup table a mouth position with what the mouth position indicates) to be indicative of the user providing or being about to provide audible input. As another example, one or more signals from a camera gathering images of a user and providing them to a processor of the device may be analyzed, examined, etc. by the device for whether the user's eyes and even more particularly the user's pupils are directed at, around, or toward the device (which may be determined using eye tracking software), which may be indicative of the user providing or being about to provide audible input based on the user's eyes being directed to the device. Conversely, determining that a user's eyes are not looking e.g. at, around, or toward the device (e.g. gazing into the distance and/or the user's face being turned away from the device (e.g. predetermined and/or threshold number of degrees from the device relative to e.g. a vector established by the user's line of sight when looking away)) may cause the logic to determine that the user is not providing audible input to the device even if audio is received from the user and hence should not be processed.

Regardless, if at diamond 204 the logic determines that the user's mouth and/or eyes are not indicative of providing audible input or being about to provide audible input, the logic may revert back to diamond 202 and proceed from there. If, however, at diamond 204 the logic determines that the user's mouth and/or eyes are indicative of providing audible input or being about to provide audible input, the logic instead moves to block 206 where the logic begins processing an audible input sequence (and/or waits for an audible input sequence to be provided) and/or executing a function responsive to receiving the audible input sequence. Thereafter, the logic proceeds to decision diamond 208 where the logic determines whether a "speech separator" has been received that while input by the user does not e.g. form part of the (e.g. intended) audible input sequence, is erroneous input to the device, is meaningless to and/or unintelligible to the device, and/or does not form part of a command to the device.

Such a "speech separator" may be identified by the device as such e.g. responsive to determining that the "speech separator" is a word in a different language relative to other portions of the audible input (e.g. than the majority of the input and/or the first word or words spoken by the user as input), responsive to determining that the "speech separator" that is input is not an actual word in the language being spoken when providing other portions of input in the language, and/or responsive to determining that the "speech separator" input by the user matches a speech separator in a data table of speech separators that are to be ignored by the device when processing e.g. an audible command sequence. In addition to or in lieu of the foregoing, a "speech separator" may be identified by the device as such responsive to a determination that the "speech separator" is unintelligible at least in part based on application of lip reading software on at least one image of the user's face gathered by a camera of the device to determine that while audio is being received by the device, the audio is a sound from e.g. a closed mouth and/or immobile/still mouth that does not form part an actual word. In any case, it is to be understood that e.g. responsive to the "speech separator" input being identified as such, the device ignores the "speech separator" input, excludes it from being part of the audible input sequence to be processed, and/or otherwise does not process it as part of the audible input sequence and/or command in which it was provided.

For instance, if input to the device is, "Please find the nearest uhh restaurant," each word in the input may be compared against a table of English words, where e.g. "nearest" and "restaurant" are determined to be English words based on matching the words being input to respective corresponding entries in the table of English words (e.g. and/or determined to form part of the command based on being words of the same language as the initial word "please"), while "uhh" is determined to not be an English word and hence should not be processed as part of the command (e.g. and/or is eliminated from the audible input sequence as processed by the device). In addition to or in lieu of the foregoing, "uhh" may be identified as an input that is to be ignored by the device based on the "uhh" being in a table of "speech separators" and/or being unintelligible input.

Still in reference to FIG. 2, if an affirmative determination is made at diamond 208 then the logic may revert back to block 206 and continue processing an audible input sequence and/or ignoring and/or declining to include "speech separators" as part of the sequence while still processing other portions of audio from the user as part of the sequence. In this respect, the "speech separator" may extend the audible input sequence application's (e.g. continuous and/or substantially continuous) processing of audio without a pause as will be discussed further below. However, if a negative determination is made at diamond 208, the logic instead proceeds to decision diamond 210.

At decision diamond 210, the logic determines whether another operation (e.g. another application) on the device is being engaged with and/or in by the user. For instance, if the logic determines that a user is manipulating a touch-enabled display of the device to browse the Internet using a browser application, the logic may proceed to block 212 where the logic pauses processing of the audible input sequence e.g. for the duration that the user is manipulating the other application (e.g. the browser application) so as to e.g. not process audio that does not form and/or was not meant to form part of a command to the device.

Though not borne out from the face of FIG. 2, it is to be understood that in some embodiments determining that another operation is being engaged with or in accordance with present principles may be combined with determining that the user has stopped providing the audible input sequence (e.g. and/or altogether stopped providing audio) to nonetheless not pause or time out processing of the audible input as it otherwise may but to continue "listening" for input from a sequence at least already partially provided while the user e.g. browses the Internet for information useful for the audible input sequence.

However, as shown in the exemplary logic of FIG. 2, the logic may responsive to determining that the user is engaging another operation and/or application of the device proceed to block 212 to pause processing e.g. regardless of whether the user is still speaking and/or providing audible input, or proceed to block 212 based on the affirmative determination at diamond 210 combined with determining that the user has stopped providing audio whatsoever (e.g. has stopped speaking based on execution of lip reading software on an image of the user to determine that the user's lips are no longer moving and hence the user is no longer providing input to the device).

Regardless, note that a negative determination at diamond 210 causes the logic to proceed to decision diamond 214. At diamond 214, the logic determines whether one or more signals from an accelerometer of the device and/or from a facial proximity sensor of the device are indicative of the device being outside a distance threshold and/or being moved to outside the distance threshold, where the distance for the threshold is relative to the distance between the device and the user's face. Thus, for instance, an affirmative determination may be made at diamond 214 based on the user removing (e.g. to at least a predefined distance) the device from the user's facial area because e.g. the user does not intend to provide any further input to the device. However, despite the foregoing, in some embodiments the logic at diamond 214 may nonetheless proceed to decision diamond 216 (to be described below) if, despite the device being beyond the distance threshold to the user, it is also determined at diamond 214 that the user continues to speak e.g. even if the audio being spoken is a "speech separator."

In any case, it is to be understood that responsive to an affirmative determination, the logic reverts back to block 212. However, a negative determination at diamond 214 causes the logic to move to decision diamond 216 where the logic determines whether an audible pause in the audible input sequence has occurred. For instance, an audible pause may be the user pausing speaking (e.g. altogether and/or not providing any sound) and/or ceasing to provide audible input to the device. The determination made at diamond 216 may be based on a determination that the user's current facial expression (based on an image of the user gathered by a camera of the device) is indicative of not being about to provide audible input based the user's mouth being at least mostly closed (and/or immobile/still), based the user's mouth being closed (and/or immobile/still), and/or based on the user's mouth being at least partially open (e.g. but immobile/still).

If a negative determination is made at diamond 216, the logic may revert back to block 206. However, if an affirmative determination is made at diamond 216, the logic instead proceeds back to block 212 and pauses processing audible input as described herein. The logic of FIG. 2 then continues from block 212 to decision diamond 218 (e.g. regardless of from which decision diamond that block 212 is arrived at). At diamond 218, the logic determines whether a threshold time has expired during which no touch input has been received at the touch-enabled display, which may be indicative of the user (e.g. after engaging in another operation of the device using the touch-enabled display as set forth herein) e.g. resuming or being about to resume providing audible input to the device (e.g. after the user locates using the Internet browser information useful for providing the audible input). Thus, in instances where a user has engaged in another operation of the device, decision diamond 218 may be reached while in other embodiments the logic may proceed from block 212 directly to decision diamond 220, to be described shortly. In any case, a negative determination at diamond 218 may cause the logic to continue making the determination at diamond 218 until such time as an affirmative determination is made. Then, upon an affirmative determination at diamond 218, the logic proceeds to decision diamond 220.

At decision diamond 220, the logic determines whether audible input is being provided to the device again based on e.g. detection of audio while the device is within a threshold distance from the user's face, based on detection of audio while the user is looking at, around, or toward the device as set forth herein, and/or based on detection of audio while the user's mouth is moving as set forth herein, etc. A negative determination at diamond 220 may cause the logic to continue making the determination of diamond 220 until such time as an affirmative determination is made. An affirmative determination at diamond 220 causes the logic to proceed to block 222 where the logic resumes processing of the audible input sequence and/or executes a command provided in and/or derived from the provided audible input sequence.

Figure 3:
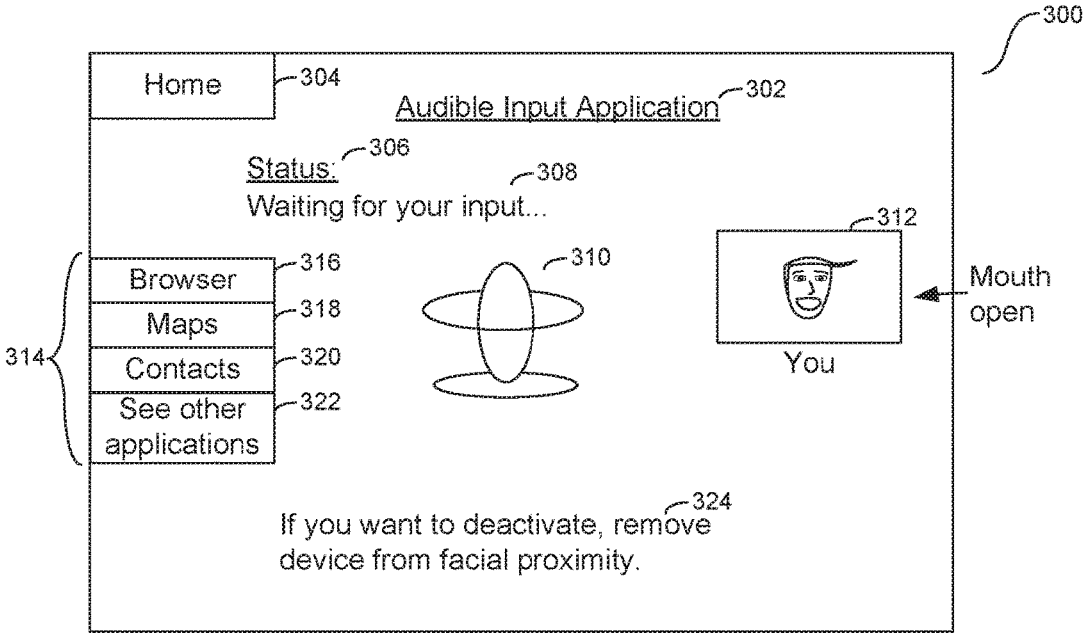
FIGS. 3-6 are example user interfaces (UIs) presentable on a device in accordance with present principles.

Continuing the detailed description now in reference to FIG. 3, it shows an exemplary user interface (UI) 300 that may be presented on a device undertaking present principles when e.g. a pause in audible input is determined to be occurring as set forth herein. As may be appreciated from FIG. 3, the UI 300 includes a heading/title 302 indicating e.g. that an application for receiving an audible command and/or an audible input sequence in accordance with present principles is initiated and running on the device and e.g. that the UI 300 is associated therewith. Also note that a home selector element 304 is shown that is selectable to automatically cause without further user input e.g. a home screen of the device (e.g. presenting icons for applications of the device) to be presented.

The UI 300 also includes a status indicator 306 and associated text 308, which in the present exemplary instance indicates that the application has paused and/or that it is waiting for audible input from a user (e.g. responsive to determination that audible input is not being provided at just before and/or during the period that the UI 300 is presented). Thus, the exemplary text 308 indicates that the device and/or application is "Waiting for [the user's] input . . . " An exemplary image and/or illustration 310 such as a microphone is also shown to indicate e.g. that a user should speak at or near the device presenting the UI 300 to provide audible input and e.g. to provide an illustration of an act (e.g. speaking) that should be undertaken by the user to engage with the application. Note that while receiving an audible input sequence, a UI with some of the same selector elements may be presented (e.g. the elements 314 to be described shortly) and that at least a portion of the microphone 310 may change color from a first color when audible input is being received to a second color different from the first color when the audible input application is "waiting" for input as shown on the UI 300.

In any case, the UI 300 also includes an exemplary image 312 of the user as e.g. gathered by a camera on and/or in communication with the device presenting the UI 300. The image 312 may be e.g. a current image that is updated at regular intervals (e.g. every tenth of a second) as new images of the user are gathered by the camera and thus may be an at least substantially real time image of the user. Note that in the image 312, the user's mouth is open but understood to be e.g. immobile and/or still, e.g. leading to a determination by the device that audible input is not being provided. Plural selector elements 314 for applications, functions, and/or operations of the device presenting the UI 300 other than the audible input application are shown so that e.g. a user may toggle between the audible input application and another application while still e.g. leaving the audible input application open and/or paused. Thus, each of the following selector elements are understood to be selectable to automatically without further user input launch and/or cause the application associated with the particular selector element that is selected to be e.g. initiated and to have an associated UI presented on a display of the device: a browser selector element 316 for e.g. an Internet browser application, a maps selector element 318 for e.g. a maps application, and/or a contacts selector element 320 for e.g. a contacts application and/or contacts list. Note that a see other apps selector element 322 is also presented and is selectable to automatically cause without further user input a UI to be presented (e.g. a home screen UI, an email UI associated with an email application, etc.) presenting e.g. icons of still other applications that are selectable while the audible input application is "paused."

In addition to the foregoing, the UI 300 includes instructions 324 indicating that, should the user wish to close the audible input application and/or end the particular audible input sequence that was being input by the user prior to the pause detected by the device, a command to do so (e.g. automatically) may be input to the device by e.g. removing the device from the user's facial proximity (e.g. a threshold distance away from at least a portion of the user's face). However, note that the instructions 324 may indicate that the application may be closed by still other ways such as e.g. inputting an audible command to close the application and/or end processing of the audible input sequence, engage another application and/or operation of the device for a threshold time to close the application and/or end processing of the audible input sequence (e.g. after expiration of the threshold time), not providing audible input (e.g. providing an audible pause and/or not speaking) within a threshold time to close the application and/or end processing of the audible input sequence (e.g. after expiration of the threshold time), not providing touch input to the display presenting the UI 300 for a threshold time to close the application and/or end processing of the audible input sequence, etc. (e.g. after expiration of the threshold time).

Figure 4:
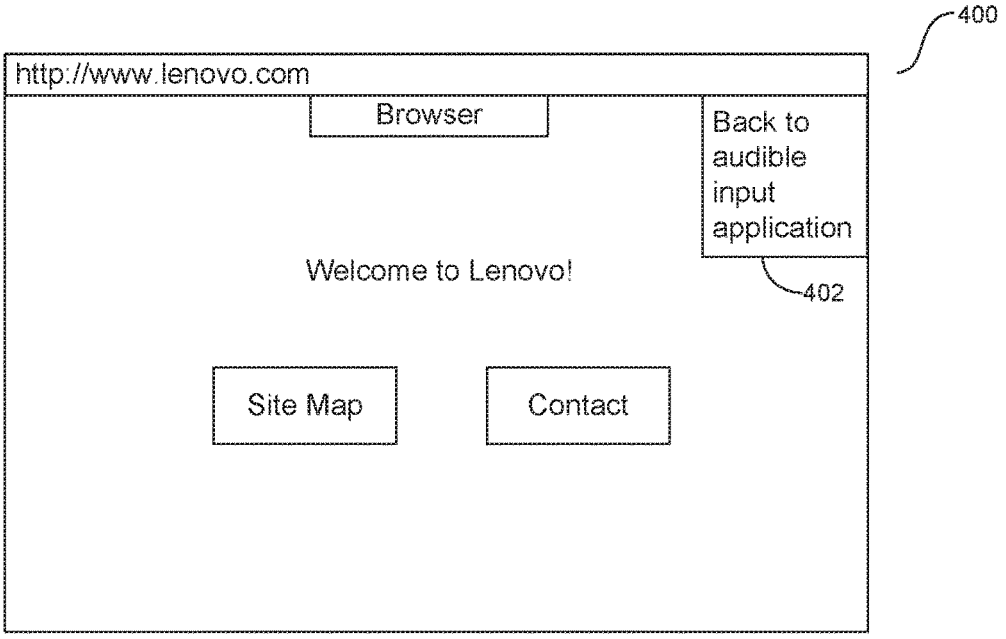

Turning now to FIG. 4, an exemplary UI 400 is shown that may be presented on a device in accordance with present principles e.g. automatically without further user input responsive to selection of the element 316 from the UI 300. In the present instance, the UI 400 is for an Internet browser. Note that the UI 400 includes a selector element 402 selectable to automatically cause without further user input e.g. the UI 300 or another UI for the audible input application in accordance with present principles to be presented.

Thus, as an example, a user may in the middle of and/or while providing an audible input sequence decide that information to complete the audible input sequence should be accessed from the Internet using the browser application. The user may select the element 316, browse the Internet using the browser application to get e.g. contact information from Lenovo, Singapore, Ltd.'s website, and then return to the audible input application to finish providing the audible input sequence with input including contact information for Lenovo, Singapore, Ltd. An exemplary audible input sequence in the present instance may be e.g. "Please use the telephone application to call . . . [pause in input while user engages with Internet browser] . . . the telephone number five five five Lenovo one." In numerical terms, the number would be e.g. (555) 536-6861.

Figure 5:
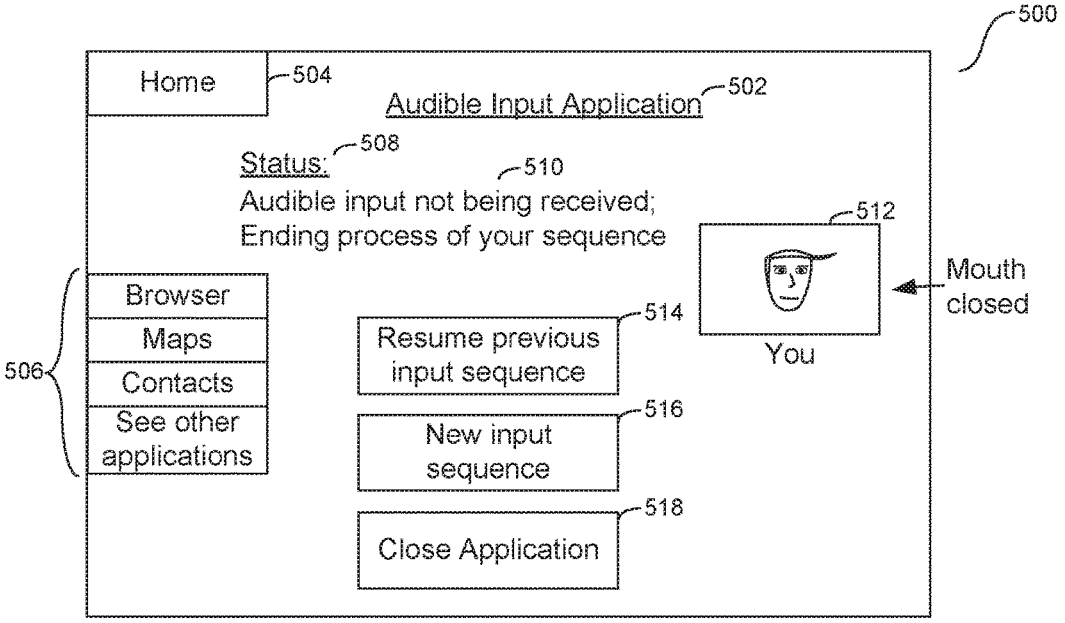

Continuing the detailed description in reference to FIG. 5, it shows an exemplary UI 500 associated with an audible input application in accordance with present principles. Note that a heading/title 502 is shown that may be substantially similar in function and configuration to the heading 302, a home selector element 504 is shown that may be substantially similar in function and configuration to the home element 304, plural selector elements 506 are shown that may be respectively similar in function and configuration to the elements 314 of FIG. 3, and an image 512 is shown that may be substantially similar in function and configuration to the image 312 (e.g. with the exception that the real time image as shown includes the user's mouth being closed thus reflecting that audible input is not being provided by the user).

The UI 500 also shows a status indicator 508 and associated text 510, which in the present exemplary instance indicates that the device and/or audible input application is not (e.g. currently) receiving audible input and indicating that processing of the audible input sequence will end (e.g. regardless of whether a complete audible input sequence has been received as determined by the device). The UI 500 may also include one or more of the following selector elements: a resume previous input sequence element 514 selectable to automatically without further user input cause the audible input application to e.g. open and/or resume processing for an audible input sequence that was e.g. partially input before processing of the sequence was ended so that a user may finish providing the sequence, a new input sequence element 516 selectable to automatically without further user input cause the audible input application to e.g. begin "listening" for a new audible input sequence, and a close application element 518 selectable to automatically without further user input cause the audible input application to e.g. close the audible input application and/or return to a home screen of the device.

Figure 6:
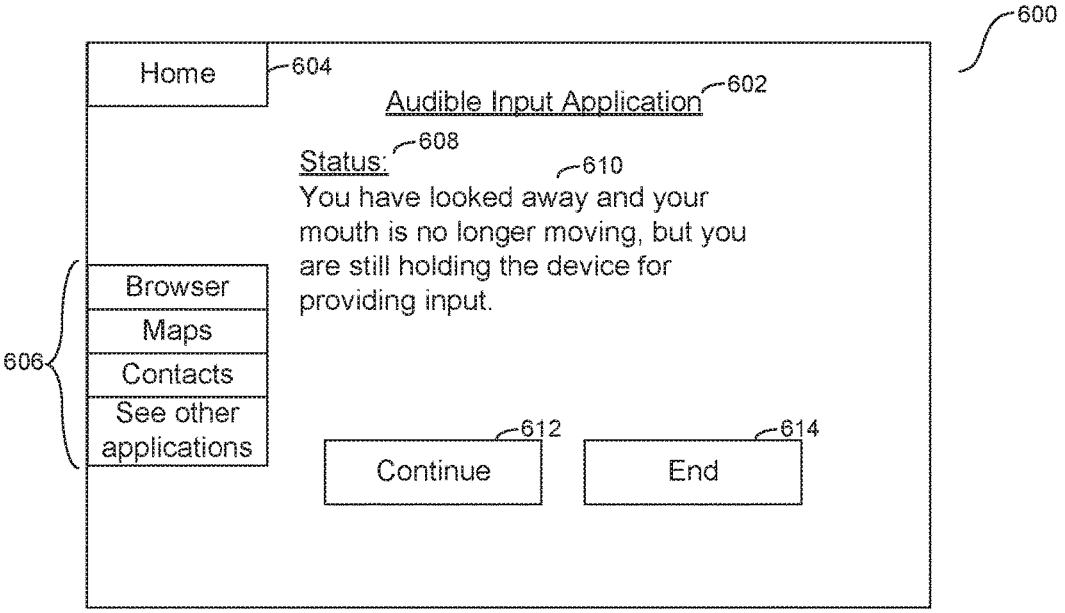

Turning now to FIG. 6, it shows an exemplary UI 600 associated with an audible input application in accordance with present principles. Note that a heading/title 602 is shown that may be substantially similar in function and configuration to the heading 302, a home selector element 604 is shown that may be substantially similar in function and configuration to the home element 304, plural selector elements 606 are shown that may be respectively similar in function and configuration to the elements 314 of FIG. 3, and although not shown an image may be also be presented on the UI 600 that may be substantially similar in function and configuration to the image 312.

The UI 600 also shows a status indicator 608 and associated text 610, which in the present exemplary instance indicates that the (e.g. as determined by the device in accordance with present principles) the user has looked away from the device and/or the user's mouth is no longer moving, but that the user still has the device positioned e.g. within a distance threshold of the user's face for providing audible input. In such an instance, the audible input application may pause processing an audible input sequence and wait for the user to resume providing it in accordance with present principles, and may also present a selector element 612 selectable to automatically without further user input provide input to the device to continue waiting to receive the audible input sequence, as well as a selector element 614 selectable to automatically without further user input end processing by the audible input application of the audible input sequence that was being input to the device and/or to close the audible input application itself.

Without reference to any particular figure, it is to be understood that although e.g. an audible input application in accordance with present principles may be vended with a device, it is to be understood that present principles apply in instances where the audible input application is e.g. downloaded from a server to a device over a network such as the Internet.

Also without reference to any particular figure, present principles recognize that movement of a device executing an audible input application and/or position of the device relative to the user may be sensed and used by the device to determine whether audible input is or will be provided in accordance with present principles. Moreover, e.g. it may be determined that a user is about to provide audible input and to thus initiate the audible input application and/or begin "listening" for audible input responsive to a determination that the user has e.g. provided a gesture detected by a camera of the device recognizable by the device as being a gesture indicating the user is or will be providing audible input to the audible input application, and/or responsive to a determination that the user has moved the device from e.g. outside of a threshold distance of the user's face to inside the threshold distance and thereafter is holding the device still, at a predefined orientation (e.g. recognizable by the audible input application and/or device as being indicative of the user being about to provide audible input and hence causing the device and/or application to begin "listening" for input (e.g. responsive to signals from e.g. an orientation sensor and/or touch sensors on the device)), and/or that the user has positioned the device at a distance (e.g. that remains constant or at least substantially constant such as e.g. within an inch) to provide audible input thereto (e.g. where the device "listens" in accordance with present principles so long as the device remains at the distance).

Also in accordance with present principles, it is to be understood that eye tracking as discussed herein may be used in an instance where e.g. the user is providing an audible input sequence, receives a text message at the device where the device determines that it is to pause processing of the audible input sequence responsive to a determination that the user's eyes are focused on at least a portion of the text message and/or that the user has stopped providing audible input and/or stopped speaking altogether, and then resume processing of the audible input sequence responsive to the determining that the user is again providing audible input to the device and/or that the screen presenting the text message is closed or otherwise exited.

As another example, assume a user begins providing an audible input sequence in accordance with present principles, pauses providing the sequence to engage another operation of the device, and then determines that the context and/or a previous input portion of the sequence should be changed based on resumption of audible input being provided and processed. In such an instance, the device may e.g. recognize a "key" word provided by the user to e.g. automatically without further user input responsive thereto ignore the most-recently provided word prior to the pause and hence decline to process it as part of the audible input sequence to be finished after the pause. In addition to or in lieu of the foregoing, the device may e.g. recognize two words separated by a user's pause in providing the audible input as being similar and/or conflicting in that they both cannot be processed compatibly to execute a command (e.g., both words being nouns, both words being different cities but the context of the sequence being directed to information for a single city, etc.). But regardless, in some embodiments where the context of the sequence changes after a pause, the context as modified after the pause and/or words input after the pause are processed as the operative ones to which the sequence pertains.

Also note that although not provided as a figure, a settings UI associated with an audible input application may be presented on a device executing the audible input application to thus configure one or more settings of the device. For instance, particular selector elements for other operations and/or applications may be set by a user for presentation on a UI such as the UI 300, one or more of operations for determining whether a pause in audible input has occurred and when audible input has resumed as described above may be enabled or disabled (e.g. based on a toggle on/off element), etc.

While the particular DETECTING PAUSE IN AUDIBLE INPUT TO DEVICE is herein shown and described in detail, it is to be understood that the subject matter which is encompassed by the present application is limited only by the claims.

What is claimed is:

1. A device, comprising:

at least one processor; and storage accessible to the at least one processor and comprising instructions executable by the at least one processor to:

process first audible input received from a user;

pause processing of audible input based at least in part on a determination that audible input is no longer being received;

subsequently receive second audible input from the user;

process the second audible input;

based at least in part on the processing of the second audible input, determine whether at least a portion of the first audible input is incompatible with at least a portion of the second audible input; and in response to a determination that at least the portion of the first audible input is incompatible with at least the portion of the second audible input, execute a command based at least in part on the portion of the second audible input but not the portion of the first audible input that is incompatible with the portion of the second audible input.

2. The device of claim 1, wherein the determination that audible input is no longer being received is based at least in part on identification of a pause in words spoken by the user.

3. The device of claim 2, wherein the pause comprises an audible sequence separator that is unintelligible to the device.

4. The device of claim 1, wherein the second audible input is processed based on a determination that the user has resumed speaking.

5. The device of claim 4, wherein the determination that the user has resumed speaking is based on input from a camera.

6. The device of claim 5, wherein the input from the camera indicates the user's mouth as being open.

7. The device of claim 5, wherein the input from the camera indicates the user's mouth as being open and still.

8. The device of claim 1, wherein the determination that audible input is no longer being received is based at least in part on a determination that the user's eyes are not looking toward the device.

9. The device of claim 1, comprising a touch-enabled display accessible to the at least one processor, and wherein the determination that audible input is no longer being received is based at least in part on a determination that the user is engaging another operation using the touch-enabled display.

10. A method, comprising:

processing first audible input received from a user;

pausing processing of audible input based at least in part on a determination that audible input is no longer being received;

subsequently receiving second audible input from the user;

processing the second audible input;

based at least in part on the processing of the second audible input, determining whether at least a portion of the first audible input is incompatible with at least a portion of the second audible input; and in response to determining that at least the portion of the first audible input is incompatible with at least the portion of the second audible input, executing a command based at least in part on the portion of the second audible input but not the portion of the first audible input that is incompatible with the portion of the second audible input.

11. The method of claim 10, wherein the determining that audible input is no longer being received is based at least in part on identifying a pause in words spoken by the user.

12. The method of claim 11, wherein the pause comprises an audible sequence separator that is unintelligible to the device.

13. The method of claim 10, wherein the second audible input is processed based on determining that the user has resumed speaking.

14. The method of claim 13, wherein the determining that the user has resumed speaking is based on input from a camera.

15. The method of claim 14, wherein the input from the camera indicates the user's mouth as being open.

16. The method of claim 14 wherein the input from the camera indicates the user's mouth as being open and still.

17. The method of claim 10, wherein the determining that audible input is no longer being received is based at least in part on determining that the user's eyes are not looking toward the device.

18. The method of claim 10, wherein the determining that audible input is no longer being received is based at least in part on a determination that the user is engaging another operation using a touch-enabled display.

19. A computer readable storage medium (CRSM) that is not a transitory signal, the computer readable storage medium comprising instructions executable by at least one processor to:

process first audible input received from a user;

pause processing of audible input based at least in part on a determination that audible input is no longer being received;

subsequently receive second audible input from the user;

process the second audible input;

based at least in part on the processing of the second audible input, determine whether at least a portion of the first audible input is incompatible with at least a portion of the second audible input; and in response to a determination that at least the portion of the first audible input is incompatible with at least the portion of the second audible input, execute a command based at least in part on the portion of the second audible input but not the portion of the first audible input that is incompatible with the portion of the second audible input.

20. The CRSM of claim 19, wherein the determination that audible input is no longer being received is based at least in part on identification, based on input from a camera, of a pause in words spoken by the user.

* * * * *